US008602823B2

(12) United States Patent
Jimbo

(10) Patent No.: US 8,602,823 B2
(45) Date of Patent: Dec. 10, 2013

(54) SHIELD CONNECTOR

(75) Inventor: Tomoki Jimbo, Makinohara (JP)

(73) Assignee: Yazaki Corporation, Tokyo (JP)

( * ) Notice: Subject to any disclaimer, the term of this patent is extended or adjusted under 35 U.S.C. 154(b) by 57 days.

(21) Appl. No.: 13/445,065

(22) Filed: Apr. 12, 2012

(65) Prior Publication Data

US 2012/0264331 A1 Oct. 18, 2012

(30) Foreign Application Priority Data

Apr. 13, 2011 (JP) ..... 2011-089218

(51) Int. Cl.
*H01R 9/03* (2006.01)

(52) U.S. Cl.
USPC ..... 439/607.5; 439/694

(58) Field of Classification Search
USPC ..... 439/610, 607.06, 608, 101, 609, 108, 439/466, 467, 607.5, 694
See application file for complete search history.

(56) References Cited

U.S. PATENT DOCUMENTS 5,691,506 A * 11/1997 Miyazaki et al. ..... 174/652
6,042,396 A * 3/2000 Endo et al. ..... 439/98
6,344,612 B1 * 2/2002 Kuwahara et al. ..... 174/50
6,583,352 B2 * 6/2003 Fukushima et al. ..... 174/373
7,165,995 B2 * 1/2007 Fukushima et al. ..... 439/607.58
7,597,580 B1 * 10/2009 Advey et al. ..... 439/383
8,460,015 B2 * 6/2013 Deno et al. ..... 439/98
2004/0057187 A1 3/2004 Kuboshima et al.

FOREIGN PATENT DOCUMENTS

JP 2004119047 A 4/2004

* cited by examiner

*Primary Examiner* — Neil Abrams
*Assistant Examiner* — Phuongchi T Nguyen
(74) *Attorney, Agent, or Firm* — Sughrue Mion, PLLC

(57) ABSTRACT

A shield connector includes an insulative housing and a shield shell. The insulative housing includes a terminal holding part for holding a terminal and a wire holding part for holding a wire to be electrically connected to the terminal. The shield shell includes a first section accommodating the insulative housing and a second section integrally formed with the first section. The second section includes a groove part which is configured to position the wire therein and an extending part which is extended from an edge of the groove part and closes an opening of the groove part so as to form a tubular structure. The braided member covers the tubular structure. The fixing member is provided around the tubular structure and fastens the braided member to the tubular structure so as to electrically connect the braided member to the shield shell.

6 Claims, 10 Drawing Sheets

SHIELD CONNECTOR

BACKGROUND

The present invention is related to a shield connector, and is particularly related to a shield connector having a structure that an L shaped housing made of a resin is accommodated in a shield shell made of a metal plate.

FIG. 8 shows a conventional shield connector.

The shield connector 100 is disclosed in the patent literature 1 and includes an L shaped housing 110 made of a resin, an electromagnetically shielding braided member 120 and a shield shell 130 made of a metal plate.

In the housing 110 made of the resin, one end of an L shaped structure serves as a terminal holding part 111 that holds a connecting terminal 140 and the other end serves as an electric wire holding part 112 that holds an electric wire 150 connected to the connecting terminal 140. Extending directions of the terminal holding part 111 and the electric wire holding part 112 are orthogonal to each other to form the L shaped structure.

The braided member 120 has a form of a tube with which the electric wire 150 connected to the connecting terminal 140 is coated and is grounded together with the shield shell 130 to electromagnetically shield a periphery of the accommodated electric wire 150.

The shield shell 130 includes a first member 131 having a housing accommodating part 131*a* formed that accommodates the housing 110 made of the resin and a second member 132 screwed to the first member 131.

The first member 131 is a press formed product of a metal plate. The housing accommodating part 131*a* in the first member 131 is formed in a recessed shape with one side (an upper side in FIG. 8) opened.

The second member 132 is also a press formed product. The second member 132 includes a cover part 132*a* that covers an opened surface of the housing accommodating part 131 a and a braided member pressing part 132*b* that covers an upper part of an end part of the braided member 120 and is screwed to the first member 131. The braided member pressing part 132*b* is screwed to a braided member accommodating part 131*b* formed in the first member 131 to hold the braided members 120 between the first member 131 and the second member 132, so that the first member 131 is connected to the braided member 120 so as to be electrically conducted and connected to each other.

[Patent Literature 1] JP-A-2004-119047

SUMMARY

In the case of the shield connector 100 disclosed in the patent literature 1, since the shield shell 130 is the press formed product of the metal plate and includes the first member 131 and the second member 132 screwed to the first member 131, a problem arises that the number of parts is increased and a screwing process is necessary which takes much time and labor, causing a productivity to be lowered and a production cost to be increased.

As a countermeasure for reducing the number of parts, the shield shell is supposed to be formed as an integrally molded product by die-casting aluminum. However, when the shield shell is formed with die-cast aluminum, a problem arises that the production cost is increased due to an increase of weight or an increase of a material cost.

It is therefore one advantageous aspect of the present invention to provide a shield connector which can prevent an increased weight of a shield shell made of metal for accommodating an L shaped housing made of a resin or an increase of a production cost due to the use of an expensive aluminum material, does not include screwed parts included in the shield shell and can improve a productivity and reduce the production cost by reducing component parts and simplifying an assembling process.

According to one advantage of the invention, there is provided a shield connector, comprising:

an insulative housing including a terminal holding part for holding a terminal and a wire holding part for holding a wire to be electrically connected to the terminal;

a shield shell having conductivity and including a first section accommodating the insulative housing and a second section integrally formed with the first section, the second section including a groove part which is configured to position the wire therein and an extending part which is extended from an edge of the groove part and is configured to close an opening of the groove part so as to form a tubular structure in cooperation with the groove part;

a braided member, having conductivity, and configured to cover the tubular structure; and a fixing member provided around the tubular structure and configured to fasten the braided member to the tubular structure so as to electrically connect the braided member to the shield shell.

The groove part may be formed with a protruding portion configured to be engaged with a recessed part of the wire so as to regulate a movement of the wire in a direction orthogonal to a longitudinal direction of the wire.

The insulative housing may have a L-shape in which the terminal holding part is provided at one end thereof and the wire holding part is provided at the other end thereof.

The shield shell may be press formed product of a metal plate.

The shield connector may be configured such that: the extending part consists of a pair of belt shaped parts, and the belt shaped parts are extended from both sides of the groove part in a direction orthogonal to a longitudinal direction of the wire.

The fixing member may have a ring shape configured to surround the tubular structure.

DETAILED DESCRIPTION OF EXEMPLIFIED EMBODIMENTS

Figure 1:
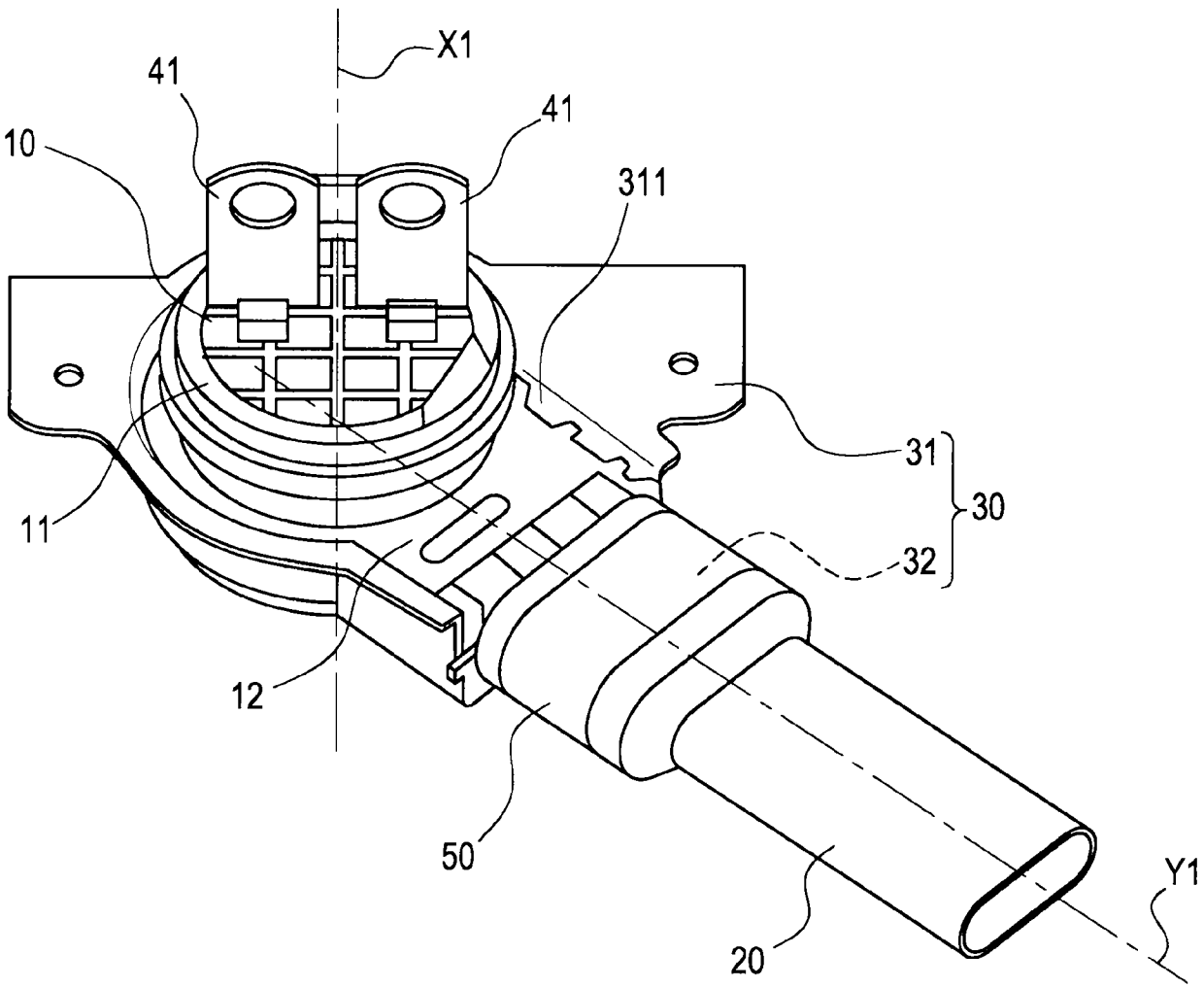
FIG. 1 is a perspective view of a shield connector according to an embodiment of the present invention seen from a connector connecting surface side on which a connecting terminal protrudes.

An embodiment of a shield connector according to the present invention will be described below in detail by referring to the drawings.

Figure 2:
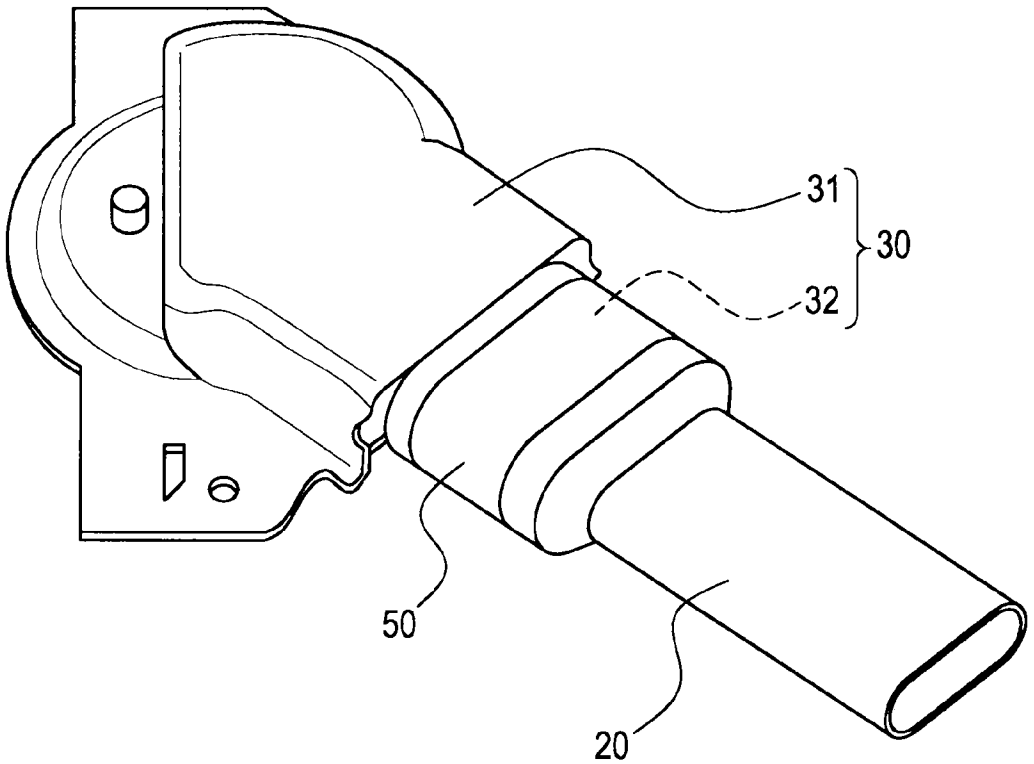
FIG. 2 is a perspective view of the shield connector in FIG. 1 seen from a back surface side opposite to the connector connecting surface.
Figure 4A:
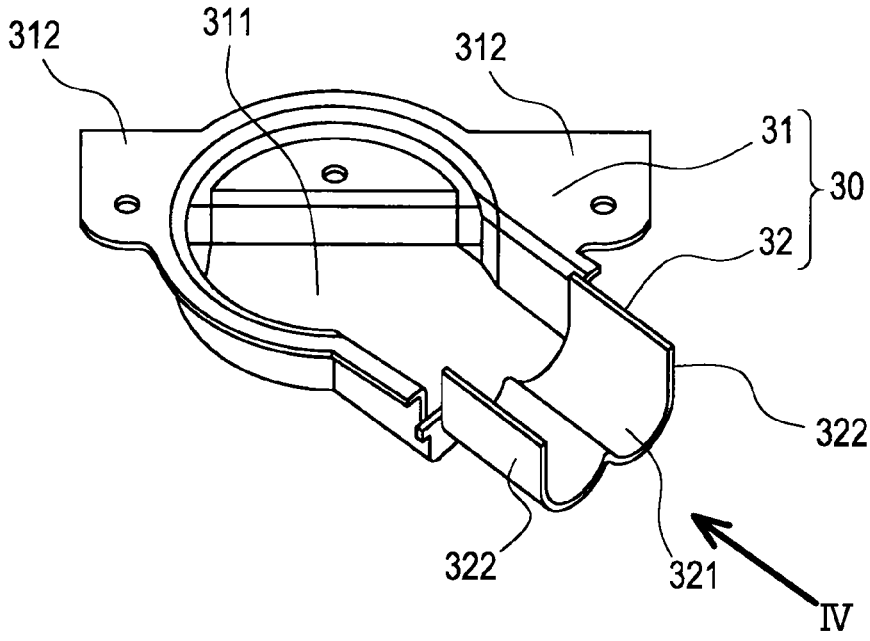
FIG. 4A is a perspective view of the shield shell seen from the front surface side in a state that the belt shaped extending part of the second member in the shield shell shown in FIG. 1 is half formed and is not completely formed.
Figure 4B:
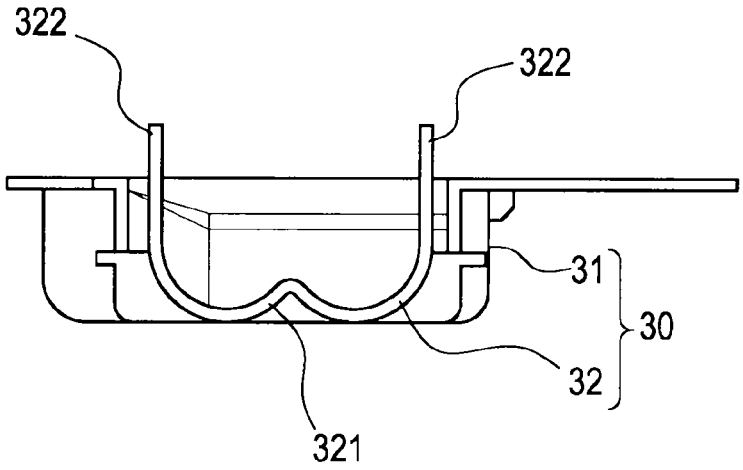
FIG. 4B is a view seen from an arrow mark IV in FIG. 4A.
Figure 4C:
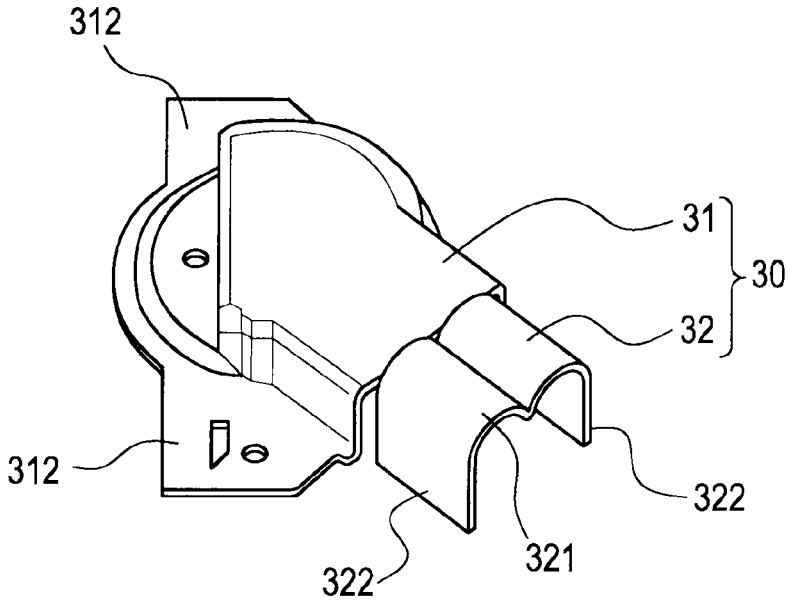
FIG. 4C is a perspective view of the shield shell seen from the back surface side in the state of FIG. 4A.
Figure 5A:
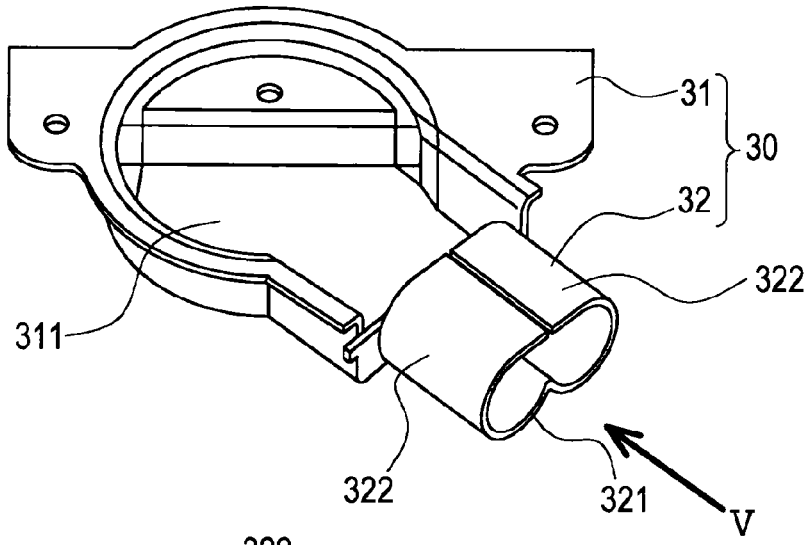
FIG. 5A is a perspective view of the shield shell seen from the front surface side in a state that the belt shaped extending part of the second member in the shield shell shown in FIG. 1 is completely formed in a tubular structure.
Figure 5B:
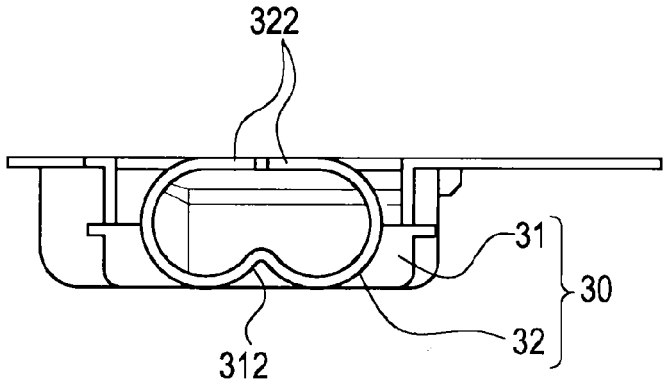
FIG. 5B is a view seen from an arrow mark V in FIG. 5A.
Figure 5C:
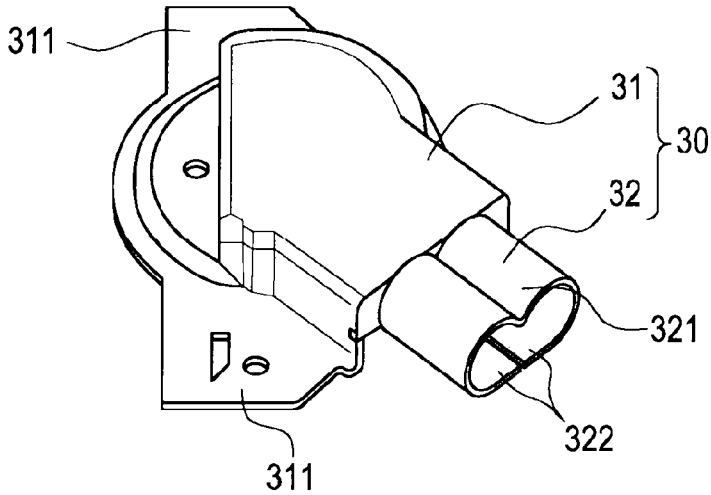
FIG. 5C is a perspective view of the shield shell seen from the back surface side in the state of FIG. 5A.
Figure 6A:
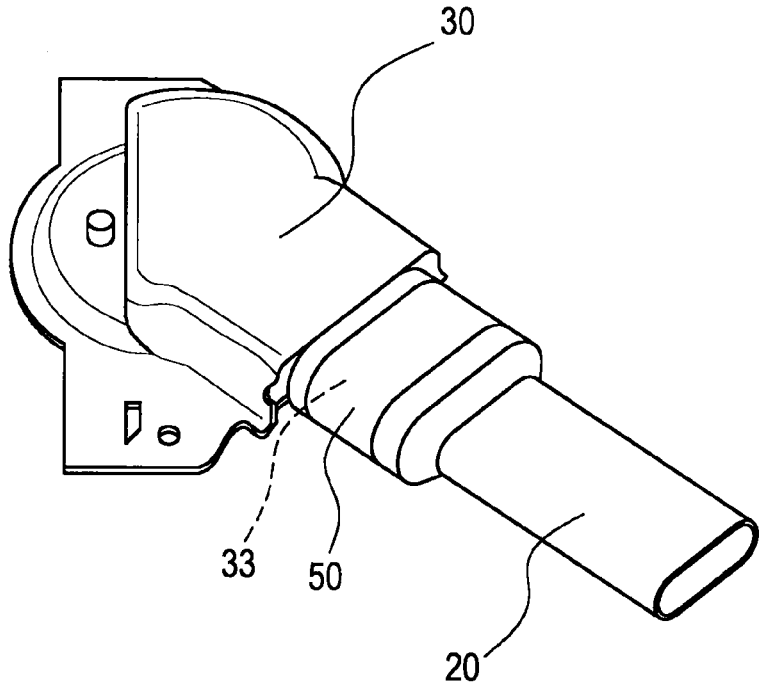
FIG. 6A is a perspective view showing a state that a braided member is electrically conducted and connected to the shield shell shown in FIG. 5C.
Figure 6B:
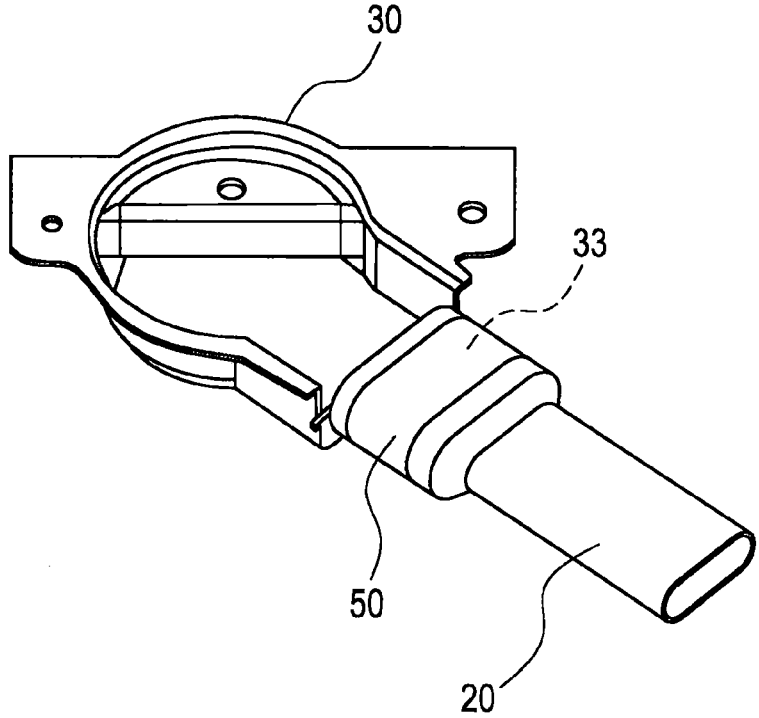
FIG. 6B is a perspective view showing a state that the braided member is electrically conducted and connected to the shield shell shown in FIG. 5A.

FIG. 1 to FIG. 6B show one embodiment of the shield connector according to the present invention. FIG. 1 is a perspective view of a shield connector according to an embodiment of the present invention seen from a connector connecting surface side on which a connecting terminal protrudes. FIG. 2 is a perspective view of the shield connector in FIG. 1 seen from a back surface side opposite to the connector connecting surface. FIG. 3A is a perspective view of the shield shell seen from a front surface side in a state before an extending part of a second member in a shield shell shown in FIG. 1 is press formed. FIG. 3B is a view seen from an arrow mark III in FIG. 3A. FIG. 3C is a perspective view of the shield shell seen from a back surface side in the state of FIG. 3A. FIG. 4A is a perspective view of the shield shell seen from the front surface side in a state that the extending part of the second member in the shield shell shown in FIG. 1 is half formed and is not completely formed. FIG. 4B is a view seen from an arrow mark IV in FIG. 4A. FIG. 4C is a perspective view of the shield shell seen from the back surface side in the state of FIG. 4A. FIG. 5A is a perspective view of the shield shell seen from the front surface side in a state that the extending part of the second member in the shield shell shown in FIG. 1 is completely formed in a tubular structure. FIG. 5B is a view seen from an arrow mark V in FIG. 5A. FIG. 5C is a perspective view of the shield shell seen from the back surface side in the state of FIG. 5A. FIG. 6A is a perspective view showing a state that a braided member is electrically conducted and connected to the shield shell shown in FIG. 5C. FIG. 6B is a perspective view showing a state that the braided member is electrically conducted and connected to the shield shell shown in FIG. 5A.

As shown in FIG. 1 and FIG. 2, the shield connector 1 of the one embodiment includes a housing 10 (an insulative housing) made of a resin, an electromagnetically shielding braided member 20 (a braided member), a shield shell 30 made of metal and a ring member 50 (a fixing member) for fixing the braided member. The housing 10 has an L shape in this embodiment, but the housing 10 may be other types including straight type.

The housing 10 includes, as shown in FIG. 1, a terminal holding part 11 located at one end and an electric wire holding part 12 (a wire holding part) located at the other end which are integrally formed. The terminal holding part 11 has a substantially cylindrical form extending along a first straight line X1 shown in FIG. 1 and holds a tongue shaped connecting terminal 41 (a terminal) so as to protrude along the first straight line X1. The electric wire holding part 12 is a part that accommodates and holds a connecting part of an electric wire (a wire) connected to the connecting terminal 41 and the connecting terminal 41 and extends along a second straight line Y1 shown in FIG. 1. The second straight line Y1 is a straight line orthogonal to the first straight line X1. Accordingly, since the terminal holding part 11 of the one end and the electric wire holding part 12 of the other end are extended in directions orthogonal to each other, the housing 10 is formed in an L shaped structure.

The braided member 20 has a tubular form to cover the electric wire (not shown in the drawing) connected to the connecting terminal 41 and is grounded together with the shield shell 30 to electromagnetically shield a periphery of the accommodated electric wire.

Figure 3A:
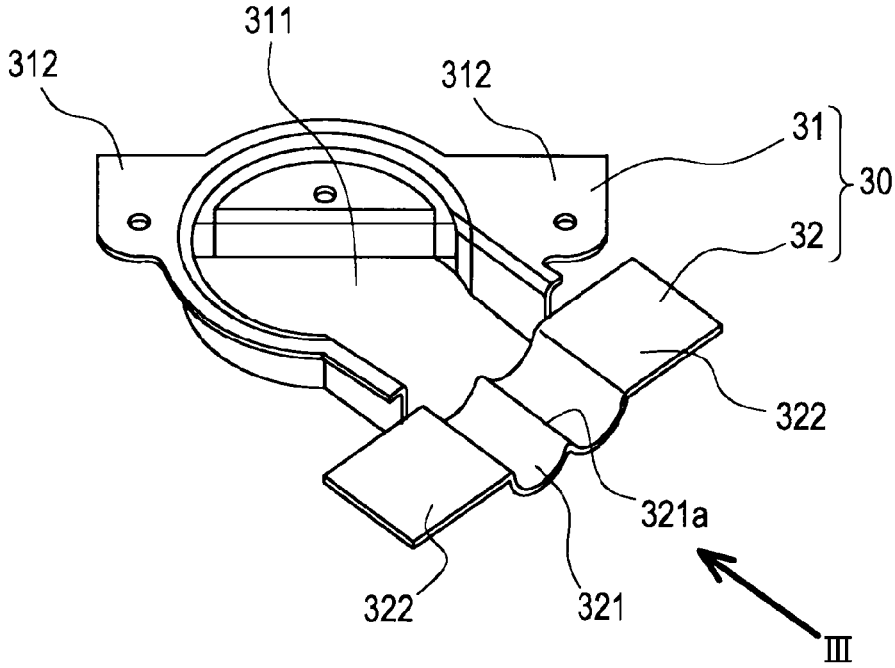
FIG. 3A is a perspective view of the shield shell seen from a front surface side in a state before a belt shaped extending part of a second member in a shield shell shown in FIG. 1 is press formed.
Figure 3B:
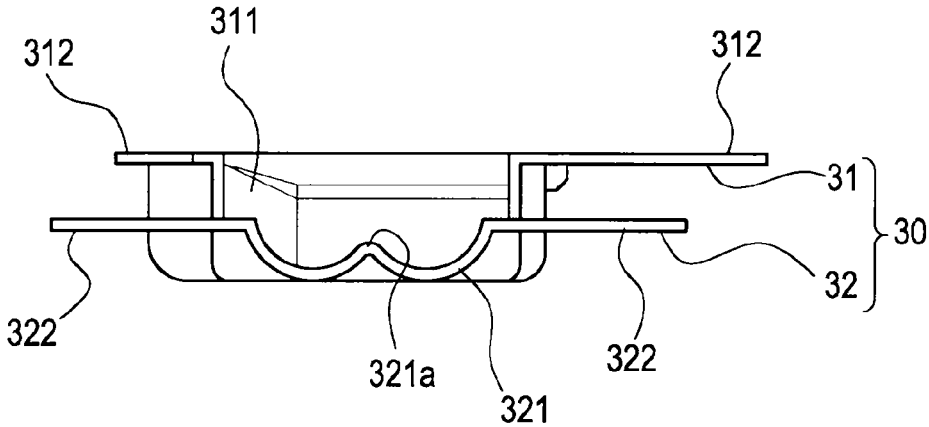
FIG. 3B is a view seen from an arrow mark III in FIG. 3A.
Figure 3C:
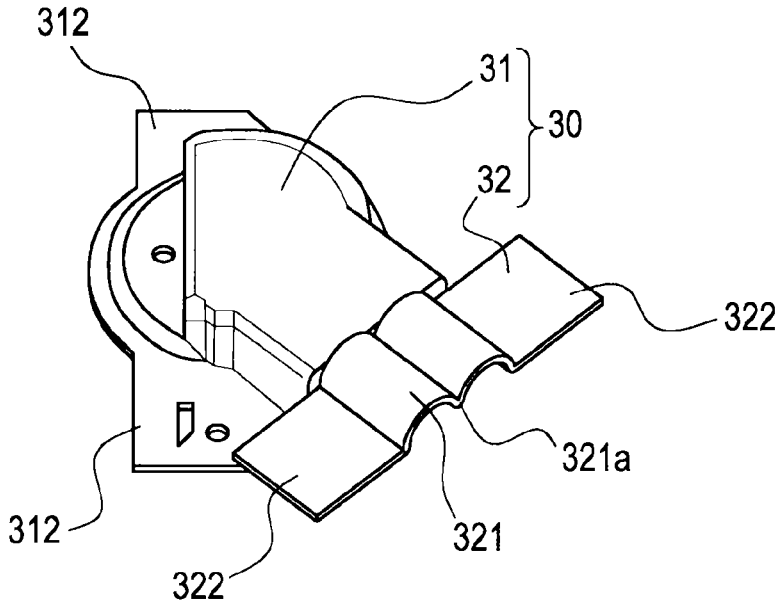
FIG. 3C is a perspective view of the shield shell seen from a back surface side in the state of FIG. 3A.

The shield shell 30 in the present embodiment is a press formed product of a metal plate. As shown in FIGS. 3A to 3C, the shield shell 30 includes a first section 31 having a housing accommodating part 311 that accommodates the housing 10 and a second section 32 that electrically conducts and connects the braided member 20 to the first section 31 to electromagnetically shield a periphery of the housing 10.

The housing accommodating part 311 is a recessed part that accommodates the housing 10. The first section 31 is provided with an attaching flange part 312 in the periphery of the housing accommodating part 311. The attaching flange part 312 protrudes in the form of a plane orthogonal to the first straight line X1 in the periphery of the housing accommodating part 311. The attaching flange part 312 is abutted against a connector attaching wall (not shown in the drawing) to which a mate side connector connected to the connecting terminal 41 is attached and screwed to the connector attaching wall so as to be fixed to the connector attaching wall.

The second section 32 includes, as shown in FIGS. 3A to 3C, a groove part 321 and an extending part 322. The extending part 322 has belt shape.

The groove part 321 is a groove shape to which the electric wire is fitted to be positioned. The groove part 321 is formed integrally with the first section 31.

Further specifically, the groove part 321 of the present embodiment forms grooves that accommodate the two electric wires. One protruding part 321*a* is formed by a press forming that is engaged with a recessed part between the two mounted electric wires to regulate a movement of the electric wires in a direction orthogonal to a longitudinal direction of the electric wire.

The extending part 322 is provided in both sides of the groove part 321. In the present embodiment, the extending part 322 is extended in the form of a belt in the direction orthogonal to the longitudinal direction of the electric wire. In other words, the extending direction of the extending part 322 is orthogonal to the second straight line Y1 in FIG. 1.

The extending part 322 is, as shown in FIGS. 3A to 3C, initially press formed in the shape of a flat plate parallel to the attaching flange part 312. However, the extending part 322 of the present embodiment is further press formed so as to cover an opening part of the groove part 321 by an additional press work as shown in FIGS. 4A to 4C and FIGS. 5A to 5C. FIGS. 4A to 4C shows a state that the extending part 322 extending in a horizontal direction is formed in the shape extending in a vertical direction by a first additional press. FIGS. 5A to 5C show a state that the extending part 322 shown in FIGS. 4A to 4C is formed in the shape that covers an upper part of the groove part 321 by a second additional press.

The extending part 322 in the present embodiment forms a tubular structure (a structure shown in FIG. 5B) 33 into which the electric wire is inserted in cooperation with the groove part 321 by the additional press works shown in FIGS. 4A to 4C and FIGS. 5A to 5C.

As shown in FIG. 5B, when the second section 32 is formed in the tubular structure 33, the braided member 20 that accommodates the electric wire is attached to the tubular structure so that an end part of the braided member 20 is fitted to an outer periphery of the tubular structure 33.

A ring member 50 has a tubular structure tightly fitted to the outer periphery of the tubular structure 33 shown in FIG. 5B. The ring member 50 is formed in the shape of the tubular structure which can be diametrically expanded or contracted by a resin material having an elastic property.

As shown in FIGS. 6A and 6B, the ring member 50 is fitted and attached to the tubular structure 33 through the braided member 20 which covers the tubular structure 33 formed by the groove part 321 and the extending part 322, so that the ring member fastens the braided member 20 to the tubular structure 33. In the shield connector 1 of the present embodiment, as shown in FIGS. 6A and 6B, since the braided member 20 is fastened to the tubular structure by the ring member 50, the braided member 20 is electrically conducted and connected to the shield shell 30.

In the shield connector 1 of the above-described embodiment, since the metal shield shell 30 that accommodates the L shaped resin housing 10 is the press formed product of the metal plate, as compared with a case that the shield shell 30 is made of die-cast aluminum, the increase of weight of the shield shell 30 can be prevented. Further, as the metal plate of a material, since a steel plate can be used, a production cost can be prevented from increasing due to the use of an expensive aluminum material.

Further, in the shield connector 1 of the embodiment, the second section 32 that electrically conducts and connects the braided member 20 to the shield shell 30 is integrally formed with the first member. The shield shell 30 is formed with single parts and screw parts are not included in the shield shell 30. Therefore, since component parts are reduced and an assembling process is simplified, productivity can be improved and the production cost can be reduced.

Further, in the shield connector 1 of the embodiment, when the electric wire connected to the housing 10 is restrained from moving in the direction orthogonal to the longitudinal direction by the protruding part 321*a* of the groove part 321 forming the second section 32 of the shield shell 30 under a state that the resin housing 10 is accommodated in the shield shell 30 and is supported in a more stable state. Accordingly, a holding performance of the electric wire can be improved in the connector.

The present invention is not limited to the above-described embodiment and may be suitably modified and improved. In addition thereto, materials, form, dimensions, numbers, arranged positions of components respectively in the above-described embodiment which can achieve the present invention may be arbitrarily used and are not limited.

Figure 7:
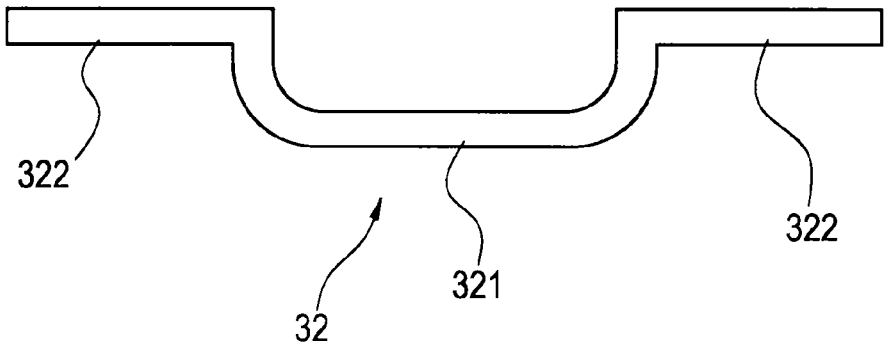
FIG. 7 is an explanatory view of other embodiment of the second member of the shield shell according to the present invention.
Figure 8:
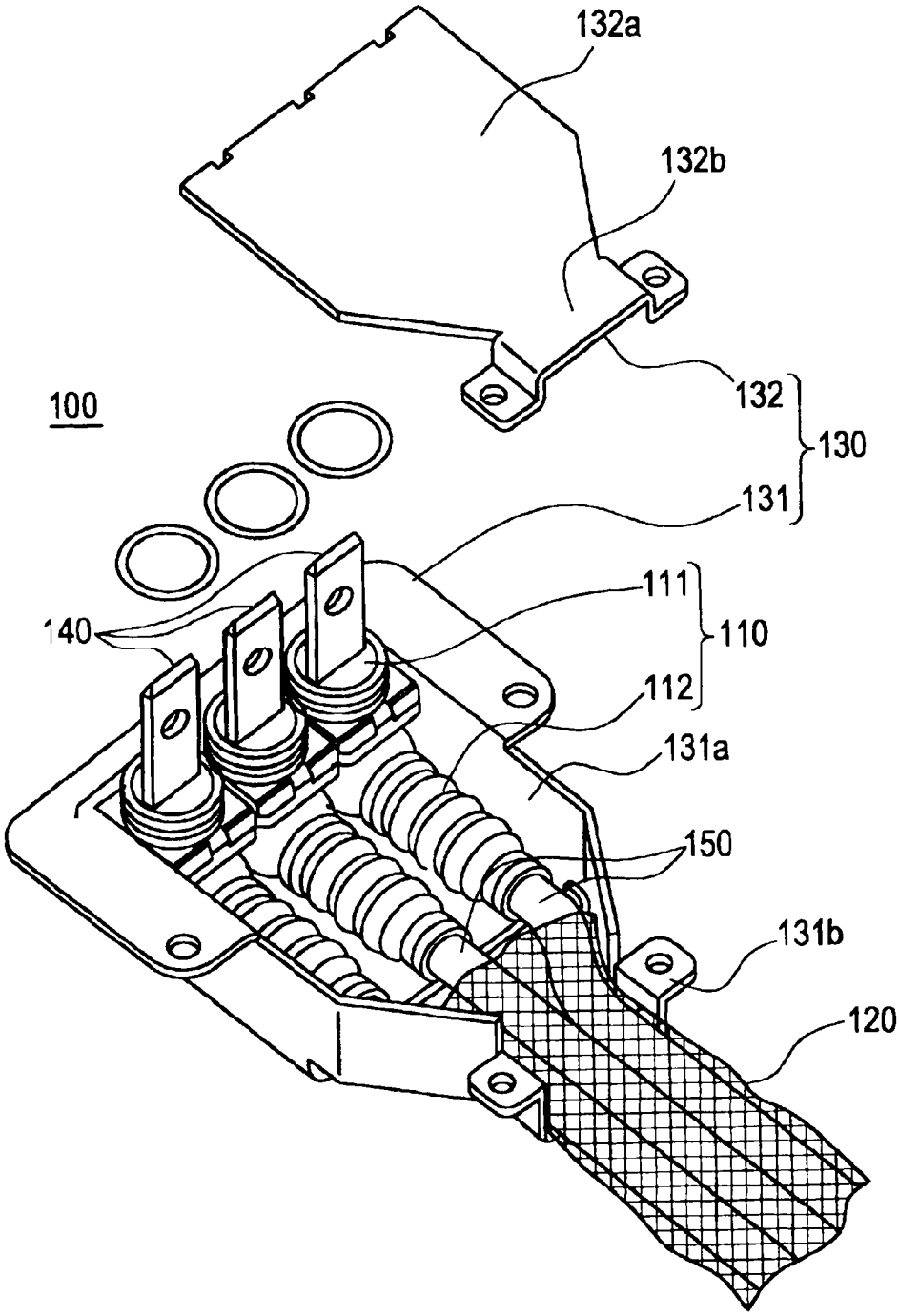
FIG. 8 is an exploded perspective view showing the structure of a conventional shield connector.

For instance, the groove part 321 of the second section 32 may be set to a simple form with the protruding part 321*a* omitted as shown in FIG. 7.

What is claimed is:

1. A shield connector, comprising:

an insulative housing including a terminal holding part for holding a terminal and a wire holding part for holding a wire to be electrically connected to the terminal;

a shield shell having conductivity and including a first section accommodating the insulative housing and a second section integrally formed with the first section, the second section including a groove part which is configured to position the wire therein and an extending part which is extended from an edge of the groove part and is configured to close an opening of the groove part so as to form a tubular structure in cooperation with the groove part;

a braided member, having conductivity, and configured to cover the tubular structure; and a fixing member provided around the tubular structure and configured to fasten the braided member to the tubular structure so as to electrically connect the braided member to the shield shell.

2. The shield connector as set forth in claim 1, wherein the groove part is formed with a protruding portion configured to be engaged with a recessed part of the wire so as to regulate a movement of the wire in a direction orthogonal to a longitudinal direction of the wire.

3. The shield connector as set forth in claim 1, wherein the insulative housing has a L-shape in which the terminal holding part is provided at one end thereof and the wire holding part is provided at the other end thereof.

4. The shield connector as set forth in claim 1, wherein the shield shell is press formed product of a metal plate.

5. The shield connector as set forth in claim 1, wherein the extending part consists of a pair of belt shaped parts, and the belt shaped parts are extended from both sides of the groove part in a direction orthogonal to a longitudinal direction of the wire.

6. The shield connector as set forth in claim 1, wherein the fixing member has a ring shape configured to surround the tubular structure.

* * * * *